US009228783B2

(12) United States Patent
Semiller et al.

(10) Patent No.: US 9,228,783 B2
(45) Date of Patent: Jan. 5, 2016

(54) METHOD FOR CONTROLLING THE FUEL SUPPLY TO BURNERS OF A BURNER GROUP AND BURNER CONTROLLER

(71) Applicant: Outotec (Finland) OY, Espoo (FI)

(72) Inventors: Karl Semiller, Rodgau (DE); Wolfgang Selt, Hofheim (DE); Michael Stroeder, Frankfurt am Main (DE)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 14/378,679

(22) PCT Filed: Feb. 14, 2013

(86) PCT No.: PCT/EP2013/052966

§ 371 (c)(1),
(2) Date: Aug. 14, 2014

(87) PCT Pub. No.: WO2013/120949

PCT Pub. Date: Aug. 22, 2013

(65) Prior Publication Data

US 2015/0037744 A1 Feb. 5, 2015

(30) Foreign Application Priority Data

Feb. 15, 2012 (DE) ..... 10 2012 002 784

(51) Int. Cl.

| | |
|---|---|
| ***F23D 23/00*** | (2006.01) |
| ***F27D 19/00*** | (2006.01) |
| ***F23N 1/00*** | (2006.01) |
| ***F27B 9/36*** | (2006.01) |
| ***F27B 9/40*** | (2006.01) |
| *F27D 21/00* | (2006.01) |

(52) U.S. Cl.

CPC ..... *F27D 19/00* (2013.01); *F23N 1/002* (2013.01); *F27B 9/36* (2013.01); *F27B 9/40* (2013.01); *F23N 2025/08* (2013.01); *F27D 21/0014* (2013.01); *F27D 2019/004* (2013.01)

(58) Field of Classification Search

CPC ..... F27D 19/00
USPC ..... 431/12, 86, 90; 432/49
See application file for complete search history.

(56) References Cited

U.S. PATENT DOCUMENTS

| | | | | |
|---|---|---|---|---|
| 3,257,188 | A * | 6/1966 | Morgan et al. | 65/162 |
| 2003/0041599 | A1 * | 3/2003 | Moser | 60/773 |
| 2008/0216771 | A1 | 9/2008 | Paine | |
| 2010/0173253 | A1 * | 7/2010 | Mohr et al. | 431/12 |

FOREIGN PATENT DOCUMENTS

| | | | |
|---|---|---|---|
| DE | 1508574 | B | 6/1970 |
| DE | 3835362 | A1 | 4/1990 |
| EP | 2367082 | A1 | 9/2011 |
| WO | WO 9632510 | A1 | 10/1996 |

* cited by examiner

*Primary Examiner* — Avinash Savani
(74) *Attorney, Agent, or Firm* — Leydig, Voit & Mayer, Ltd.

(57) ABSTRACT

A method for controlling a fuel supply to a plurality of burners of a burner group includes determining a temperature in the burner group as a control variable. The fuel supply to the burners of the burner group is specified in dependence on a control deviation of the temperature determined in the burner group to a specified setpoint temperature. The fuel supply is a common mean fuel supply that is specified for all of the burners of the burner group by a temperature master controller. The fuel supply is corrected for each of the burners or burner subgroups of the burner group. Each of the burners or the burner subgroups have a fuel supply slave controller. The fuel supply slave controllers use at least, one disturbance variable associated to the respective burner or the respective burner subgroup so as to perform the correcting.

11 Claims, 1 Drawing Sheet

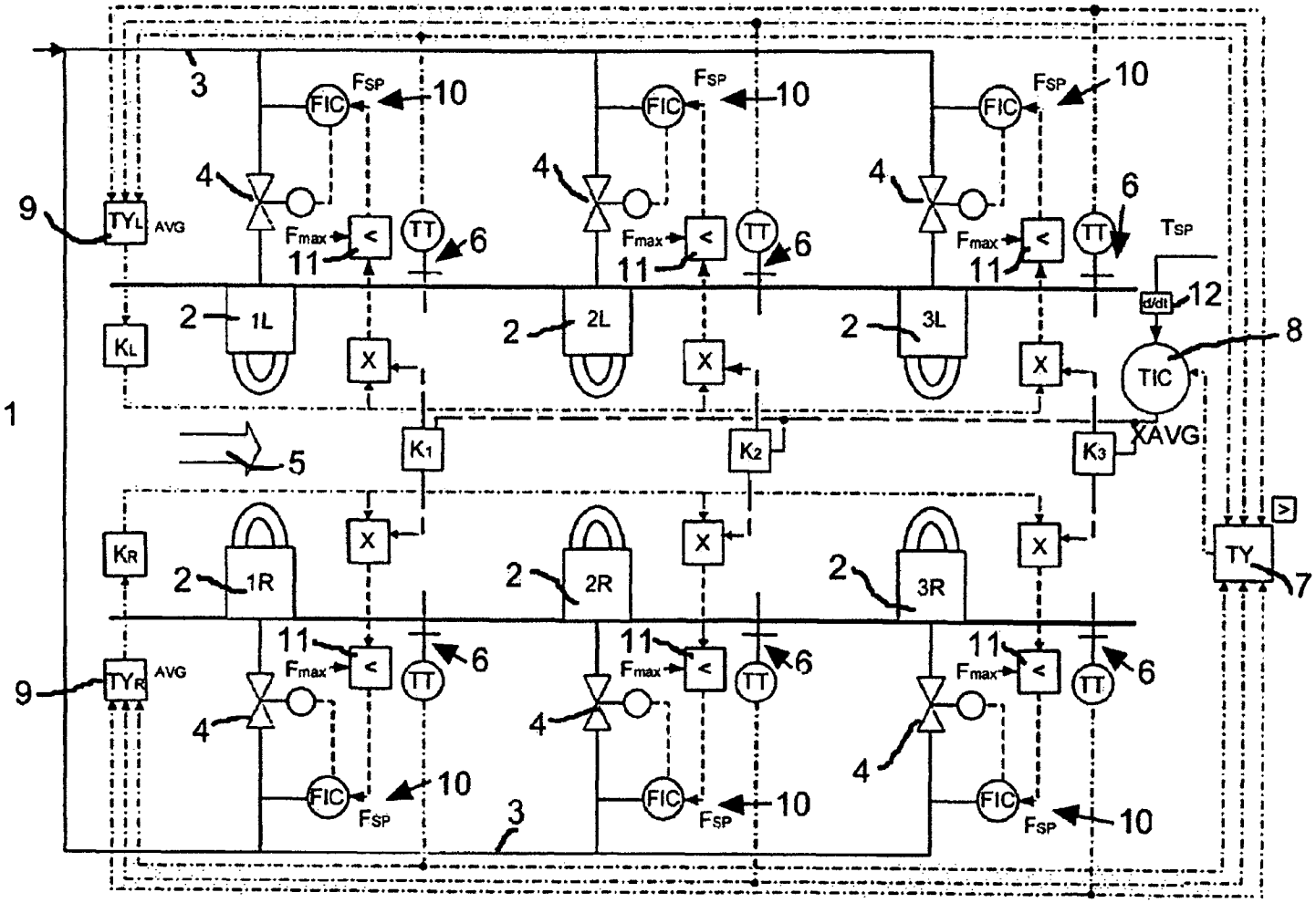
TY
TIC
TSP
XAVG
K3
K2
K1
KL
KR
TYL AVG
TYR AVG
FIC
TT
FSP
Fmax
1L
2L
3L
1R
2R
3R
1
2
3
4
5
6
7
8
9
10
11
12

METHOD FOR CONTROLLING THE FUEL SUPPLY TO BURNERS OF A BURNER GROUP AND BURNER CONTROLLER

CROSS-REFERENCE TO PRIOR APPLICATIONS

This application is a U.S. National Stage Application under 35 U.S.C. §371 of International Application No. PCT/EP2013/052966 filed on Feb. 14, 2013, and claims benefit to German Patent Application No. DE 10 2012 002 784.2 filed on Feb. 15, 2012. The International Application was published in English on Aug. 22, 2013 as WO 2013/120949 under PCT Article 21 (2).

FIELD

The invention relates to a method for controlling the fuel supply to burners of a burner group, preferably to the burner group of a large-scale industrial plant, in particular a pelletizing plant, for example, with a traveling grate firing machine, in which several burner groups are disposed, to which the control method according to an embodiment of the invention is to be applied. The invention furthermore relates to a burner controller equipped for carrying out this method and to a pelletizing plant with this burner controller. In the method proposed according to an embodiment of the invention, the temperature in the burner group is determined as a control variable, and in dependence on the control deviation of the temperature determined for the burner group (control variable) to a specified setpoint temperature (setpoint) the fuel supply to the plurality of burners of the burner group is specified as a correcting variable.

BACKGROUND

Such control methods or burner controllers can be used for example in a pelletizing plant, which in WO 96/32510 A1 is described in detail in quite a particular embodiment. The present invention, for example, relates to the firing zone of the continuous furnace, which includes a plurality of burners arranged in series to the right and left of a traveling grate, which are supplied with fuel via a fuel supply and heat up pellets applied on the traveling grate.

The burners provided in a firing zone mostly are controlled via a temperature controller, wherein the flow of the fuel to the respective burners usually is adjusted or controlled via the mean value of all burners present in the firing zone or group. This leads to the fact that all burners in the firing zone are operated with the same fuel quantity and that the burner temperature in the firing zone mostly is not uniformly distributed. Thus, in most cases another temperature exists at the end of a firing zone than at the beginning of the firing zone.

SUMMARY

In an embodiment, the present invention provides a method for controlling a fuel supply to a plurality of burners of a burner group. A temperature in the burner group is determined as a control variable. The fuel supply to the burners of the burner group is specified as a correcting variable in dependence on a control deviation of the temperature determined in the burner group to a specified setpoint temperature. The fuel supply is a common mean fuel supply that is specified for all of the burners of the burner group by a temperature master controller of a controller that is formed as temperature-to-flow cascade controller. The fuel supply is corrected for each of the burners or burner subgroups of the burner group. Each of the burners or the burner subgroups have a fuel supply slave controller. The fuel supply slave controllers use at least one disturbance variable associated to the respective burner or the respective burner subgroup so as to perform the correcting of the fuel supply for each of the burners or the burner subgroups of the burner group.

BRIEF DESCRIPTION OF THE DRAWINGS

The present invention will be described in even greater detail below based on the exemplary FIGURE. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawing which illustrates the following:

FIG. 1 schematically shows a burner group according to an embodiment of the invention.

DETAILED DESCRIPTION

In an embodiment, the present invention achieves a better heat distribution within a burner group.

In the method proposed according to an embodiment of the invention, it is provided that the controller is formed as temperature-to-flow cascade controller with a temperature master controller for all burners of the burner group and a plurality of fuel supply slave controllers for one individual burner each or for one burner subgroup each of the entire burner group. Preferably, one fuel supply slave controller each is provided for each burner and/or for each burner subgroup of the entire burner group.

The temperature master controller specifies a mean fuel supply as correcting variable for each of the burners of the burner group, i.e. a common mean fuel supply for all burners. Each of the fuel supply slave controllers provided downstream of the temperature master controller in accordance with an embodiment of the invention uses at least one disturbance variable associated to the respective burner and/or the respective burner subgroup, in order to take account of a correction of the mean fuel supply to the individual burner or the burner subgroup. In particular, it is provided that the or a fuel supply slave controller specifies the corrected fuel supply to the respective burner or the respective burner subgroup as setpoint or reference variable. The actual fuel supply, which is measured according to an embodiment of the invention or detected otherwise, is provided as control variable of the fuel supply slave controller, which is adjusted or regulated to the setpoint/the reference variable.

In the cascade control proposed according to an embodiment of the invention, the temperature master controller is a reference controller. The fuel supply slave controllers are follow-up controllers provided downstream of the reference controller. A characteristic of this cascade control consists in that the output or correcting variable of the temperature master controller is the common mean fuel supply for each, i.e. all burners of the burner group. This output or correcting variable of the master temperature controller takes account of the temperature existing in the burner group, in particular a mean temperature or a maximum temperature, and specifies the fuel required on average in the burner group as mean fuel supply, in order to adjust the desired setpoint temperature in the burner group.

The fuel supply corrected or influenced by the disturbance variable in connection with the fuel supply slave control for the individual burner or the burner subgroup, which are actuated by the slave controller, then forms the setpoint or the reference variable of this fuel supply slave control, which adjusts or specifies the actual fuel supply to each individual burner or the respectively selected burner subgroup. In accordance with an embodiment of the invention, there are provided several, at least two, fuel supply slave controllers.

Thus, since there are several fuel supply slave controllers for the burners of the burner group, as an individual controller for each burner or as a combined controller for a burner subgroup, the heat distribution within the burner group thus is adapted. This leads to a particularly advantageous equal distribution of the temperature within the burner group and often also helps to save fuel, because to achieve a mean temperature within the burner group an improved efficiency of the burners combined in the burner group is achieved due to the optimized heat distribution.

In an ideal burner group, in which each burner would provide the identical heat contribution to the total temperature of the burner group, a suitable control would be achieved already with the master temperature controller, in order to achieve the desired temperature in the burner group with an equal distribution of the heat within the burner group by adjusting the same fuel quantity supplied to all burners. In reality, however, the conditions for the individual burners are not identical. Decisive influences are obtained by the arrangement of the burners in the burner group, because for example burners located at the edge of the burner group generally give off more dissipated heat to the outside by radiation than burners located in the interior of the burner group. Further differences can be obtained by constructional conditions of the burner group, for example by a different quality of insulation in the edge region or the flow influence of a wind box shape provided in the region of the burner group. All this leads to the fact that the temperature in the burner group is not maintained exactly and in particular a non-uniform temperature distribution exists in the burner group, when all burners are supplied with the same fuel quantity.

Therefore, it is provided in accordance with an embodiment of the invention to use at least one disturbance variable in the fuel supply slave controller provided downstream of the temperature master controllers, which adjusts or specifies the fuel supply to an individual burner or a burner subgroup which preferably has similar conditions for all burners combined in the burner subgroup. Disturbance variable associated to the burners is understood to be a variable associated to a burner or a selected subgroup of burners, which indicates the deviations in the temperature distribution within the burner group for the respectively selected burner or the respectively selected burner subgroup.

In a particularly preferred embodiment of the present invention it is provided that the mean fuel supply specified by the temperature master controller as starting or correcting variable for an individual burner or a burner subgroup is influenced in dependence on the disturbance variable, in particular by correction factors formed in dependence on the disturbance variable, which are applied to the mean fuel supply, i.e. which for example are multiplied by the value of the mean fuel supply, in order to achieve an individual fuel supply for the and/or each individual burner and/or a/each burner subgroup.

Subsequently, reference in part is only made to one burner or each burner, and as used herein, burner can be understood to be both an individual burner and a burner subgroup which combines several burners of the entire burner group. This also applies in connection with the temperature measurements explained below.

According to a particularly preferred application, the determined temperature in the burner group used as control variable for the temperature master controller and/or the at least one disturbance variable can be determined from temperature measurements in particular associated to each burner. Such temperature measurements can easily be performed by means of temperature sensors in the range of action of each burner or a burner subgroup. The determined temperature in particular can be formed as maximum value of the temperature values measured for each burner or as maximum value of all temperature values measured at all in the burner group. A basis for the determination of a disturbance variable according to an embodiment of the invention is the difference of the temperature associated to a burner to a temperature associated to another burner or the determined temperature used as control variable for the temperature master controller. In the case of two burners each arranged as burner pair to the right and left in several rows in direction of movement with respect to a preferred direction, for example a direction of movement of a material to be heated by the burner group, a first disturbance variable each can be determined for a burner pair (i.e. the right and the left burner) and a further disturbance variable each can be determined for all burners arranged to the right and left (i.e. for all burners arranged to the right and left in the several rows in the burner groups).

For the first disturbance variable for example the mean value of the temperature values, which are associated to the respective burners of the burner pair, is determined and the same for example is compared with the temperature determined as control variable of the temperature master controller. From the difference, for example via a functional dependence or a value table, a suitable correction factor Kn is determined for the Nth burner pair.

For the second disturbance variable, the mean value of all temperature values associated to the right and the left burners each can analogously be determined as right and left mean value. These right and left mean values can be compared with the determined temperature serving as control variable of the temperature master controller, the total mean value formed from the right and the left mean value, or the like. From the differences resulting therefrom, for example via a functional dependence or a value table, suitable correction factors KL and KR are determined, which each are applied to the (all) left and right burners, respectively. The above-described concrete method relates to a particularly preferred burner arrangement, to which the invention however is not limited.

To be able to also consider different influences, it is provided in accordance with an embodiment of the invention that a plurality of disturbance variables for each burner or each burner subgroup can act on the mean fuel supply, i.e. the correcting variable of the temperature master controller and the reference variable of the respective fuel supply slave controller. The various disturbance variables can act on the mean fuel supply with equal priority or with a suitable weighting.

In a particularly preferred and easily realizable embodiment, correction factors therefore can be derived from the disturbance variables, which are multiplied by the mean fuel supply. In accordance with an embodiment of the invention, correction factors of individual disturbance variables and/or combined, i.e. in particular multiplied by each other, correction factors of different disturbance variables can be limited to a specified range of values, in order to avoid extreme deflections. A suitable range of values for a correction factor for example can be values from 0.5 to 2.0, which limit a change in the mean fuel supply to half or twice the amount.

For the further protection of the burner system it can be provided that the corrected fuel supply, which is obtained after using the disturbance variable(s) for the fuel supply slave controller, is limited for each burner or each burner subgroup to a maximum fuel supply which can be firmly specified or for example be fixed in a parameterizable manner. It thereby is avoided that the burner system is operated outside the intended design values.

According to a preferred embodiment, the burners of the burner group whose fuel supply is to be controlled by the proposed method can be arranged in a matrix form in several rows and/or columns, wherein disturbance variables each are determined for each row and/or each column of the burners. A preferred configuration is obtained with two columns and several rows, so that right and left burners each are arranged as burner pairs in several rows one after the other. This arrangement has already been described in detail. Such arrangement of the burners and formation of the disturbance variables also can be used particularly preferably in pelletizing plants in which material to be heated (pellets on a grate carriage or similar transporting means) is passed through a burner group of a furnace of a traveling grate firing machine in column direction.

A flexible adjustment of the controller can be achieved when the specified setpoint temperature of the temperature master controller is specifiable and/or variable, wherein the setpoint rate of change preferably is limited, in order to protect the burner system and achieve longer service lives of the refractory lining in the burner system. An expedient rate of change for example can be set to up to 100° C. per hour, wherein a larger change of the specified setpoint preferably is automatically decreased to this limit value by the controller.

Correspondingly, an embodiment of the invention also relates to a burner for controlling the fuel supply to several burners of a burner group, preferably of a large-scale industrial plant, in particular a pelletizing plant for example with a traveling grate firing machine, in which several burner groups are disposed, to which the control method according to an embodiment of the invention is to be applied. The burner controller includes at least one port for a temperature sensor and at least one port for a flow sensor, in particular for measuring the fuel supply, and to a calculating unit.

According to an embodiment of the invention, the above-described method or parts thereof are implemented in the calculating unit in particular by suitable software program means for controlling the fuel supply. According to an embodiment of the invention, the burner controller thus is equipped for carrying out the implemented method. The temperature master controllers and fuel supply slave controllers to be provided can be accommodated in a controller housing or in several different controller housings.

As a particularly preferred application, an embodiment of the invention also relates to a pelletizing plant with a traveling grate firing machine with a plurality of burners, preferably arranged in matrix form, and a burner controller for controlling the fuel supply to the plurality of burners of a burner group, which is formed as described above and equipped for carrying out the above-described method or parts thereof.

The only FIG. 1 shows a burner group 1 according to an embodiment of the invention, as it is used in burner systems of large-scale industrial pelletizing plants. In the burner group 1, burners 2 are arranged in two columns R, L and N rows, wherein FIG. 1 shows N=3 rows. Each burner 2 is supplied with fuel via a fuel supply conduit 3 and a preferably electromotively or pneumatically operated regulating valve 4 arranged in the fuel supply conduit 3.

In the transport direction indicated by the arrow 5, the material to be heated in the burner group 1 is transported on a traveling grate or similar transporting means over the burners 2, below the burners 2 or more generally past the burners 2, with the transport direction coinciding with the column direction of the burner arrangement. In particular, the material to be heated can be pellets, which in a pelletizing plant are guided through a suitable burner furnace with one or more burner groups 1.

In the combustion space formed above the burners 2, a certain temperature mostly must be adjusted, in order to achieve the desired effect. This is achieved by means of a temperature controller which adjusts the fuel supply to the individual burners 2 corresponding to the desired temperature. For this purpose, the temperature in the combustion space is repeatedly detected by temperature sensors 6, which each are associated to a burner 2 in the combustion chamber, namely each in exactly one region associated to a burner 2. The temperature values TY determined by the temperature sensors 6 are supplied to a maximum value formation 7, which forms the maximum temperature value of the temperature values TY measured in the burner group and supplies the same as a control variable to a temperature master controller 8 (TIC). In the temperature master controller 8, the control deviation between the maximum temperature value TY and the temperature setpoint TSP specified for the temperature master controller is formed. To compensate a possible control deviation, the temperature master controller 8 specifies a mean fuel supply XAVG as correcting value, with which each burner 2 would have to be supplied, if it would provide the same heat contribution to the total temperature in the combustion chamber corresponding to an ideal case.

In practice, however, this is not the case. Observations have shown that the mean temperature both of the rows and of the columns of the individual burners 2 in the burner arrangement is different. A preferred embodiment of the invention therefore proposes to detect disturbance variables associated to the rows and columns of the burners 2 in the burner arrangement and provide corresponding correction factors, in order to correct the mean fuel supply specified as a correcting variable of the temperature master controller.

A first disturbance variable relates to the rows of burners 2 in the burner arrangement, i.e. in the illustrated drawing each of the burner pairs (1L, 1R), (2L, 2R) and (3L, 3R). For each of these burner pairs, which for better clarity is not shown in the drawing, the mean temperature each of the temperature sensors associated to the respective burners 2 of a burner pair is formed. From the deviations of these mean temperatures of the various burner pairs (1L, 1R), (2L, 2R) and (3L, 3R) from each other, correction factors K1, K2 and K3 are formed with the objective to adapt the mean temperatures of all N burner pairs in the burner group 1 to each other.

For example, this can be effected such that in addition the mean value of all mean values of the individual burner pairs is formed and each individual mean value of a burner pair is compared with this total mean value. Via a suitable calculation rule or value table, a correction factor KN associated to each burner pair can be determined from this comparison or difference of these values. In FIG. 1, these are the correction factors K1, K2 and K3, which each are applied to the mean fuel supply XAVG, i.e. multiplied by this value.

A further correction is made for the columns L, R. For this purpose, the measured temperature values of the temperature sensors associated to the right burners 2 (1R, 2R, 3R) and the left burners 2 (1L, 2L, 3L) each are determined in an average formation 9. The values present as right and left mean temperature value TYR and TYL are converted into correction factors KL and KR, for example by comparison with their averages (similar to the above-described case), which are applied to the mean fuel supply corrected already by the correction factors K1, K2 and K3, in order to generate a corrected fuel supply X for each burner 2. Alternatively or in addition, experience values deposited in suitable tables can also be used, for example.

In general, disturbance variables for the burners 2 of the burner arrangement thus are considered column by column and line by line, from which column- and line-dependent correction factors K each are obtained, with which the mean fuel supply XAVG supplied by the temperature master controller 8 is corrected, in order to determine a corrected fuel supply X for each burner 2 of the burner group 1. This corrected fuel supply X is supplied as setpoint for the fuel supply to a fuel supply slave controller 10 associated to each burner 2, which compares the fuel supply setpoint FSP with the currently measured fuel supply to the burner 2 and adjusts or regulates the regulating valves 4 of the burners 2 to the fuel supply setpoint FSP by means of a correcting variable of the fuel supply slave controller 10.

By means of this control, a more uniform temperature profile within each burner group 1 of a burner system can be achieved easily and reliably via the column- and linewise correction. This leads to a more uniform burn-through of the material to be heated, which in particular can be pellets. As a side effect, the individual control of the individual burners also leads to a reduced consumption of fuel.

The fuel supply slave controller 10 thus controls the flow of fuel in the fuel supply conduit 3 and therefore is also referred to as fuel flow slave controller.

To achieve a power limitation for each burner 2, it is furthermore provided that in a maximum value formation 11 the corrected fuel supply X is compared with a maximum fuel supply FMAX, which as specified can maximally be supplied to a burner 2. If the corrected fuel supply X exceeds the maximum fuel supply FMAX, the fuel supply setpoint FSP thus is limited to the maximum fuel supply FMAX.

Similarly, for the temperature setpoint TSP which is supplied to the temperature master controller 8, a limitation of the setpoint rate of change to a certain value, for example 100° C. per hour, is provided, which is adjusted by a corresponding limiter 12. In this way, longer service lives of the refractory lining can be achieved, which ages more quickly with rising temperature gradient.

In general, the temperature-to-flow cascade controller proposed according to an embodiment of the invention thus provides for a better heat distribution in the combustion space of a burner group 1, which also leads to a saving of fuel on the whole. Due to the optional limitation of the maximum fuel supply and the setpoint rate of change, plant-specific parameters can be taken into account and/or the service life of the plant can be prolonged.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and

LIST OF REFERENCE NUMERALS

1 burner group
2 burner
3 fuel supply conduit
4 regulating valve
5 transport direction of the material to be heated
6 temperature sensor
7 maximum value formation
8 temperature master controller
9 average formation
10 fuel supply slave controller
11 minimum value formation
12 limiter
R, L column of the burner arrangement
n=1, 2, 3 row of the burner arrangement
TT temperature in the region of a burner, disturbance variable
TYL/Rtemperature of the burners arranged on the left and right, disturbance variable
TY temperature, temperature value of the burner group
TSP setpoint temperature, temperature setpoint
XAVGmean fuel supply (actuating variable of the temperature master controller)
K correction factors
X corrected fuel supply
FSP fuel supply setpoint
FMAX maximum fuel supply

The invention claimed is:

1. A method for controlling a fuel supply to a plurality of burners of a burner group, the method comprising:

determining a temperature in the burner group as a control variable;

specifying, as a correcting variable, the fuel supply to the burners of the burner group in dependence on a control deviation of the temperature determined in the burner group to a specified setpoint temperature, the fuel supply being a common mean the supply that is specified for all of the burners of the burner group by a temperature master controller of a controller that is formed as a temperature-to-flow cascade controller; and correcting the fuel supply for each of the burners or burner subgroups of the burner group, each of the burners or the burner subgroups having a fuel supply slave controller, the fuel supply slave controllers using at least one disturbance variable associated to the respective burner or the respective burner subgroup so as to perform the correcting of the fuel supply for each of the burners or the burner subgroups of the burner group, wherein the mean fuel supply specified by the temperature master controller for an individual burner or an individual burner subgroup is influenced in dependence on the at least one disturbance variable.

2. The method according to claim 1, wherein at least one of the temperature determined in the burner group and the at least one disturbance variable is determined from temperature measurements in the burner group.

3. The method according to claim 1, wherein the at least one disturbance variable is a plurality of disturbance variables for each of the burners or the burner subgroups which act on the mean fuel supply.

4. The method according to claim 1, further comprising deriving at least one correction factor from the at least one disturbance variable, and multiplying the at least one correction factor with the mean fuel supply.

5. The method according to claim 1, wherein the corrected fuel supply for each of the burners or the burner subgroups is limited to a maximum fuel supply.

6. The method according to claim 1, wherein the burners are arranged in a matrix form in a plurality of rows, a plurality of columns, or both, and wherein the at least one disturbance variable is a plurality of disturbance variables that are determined for each one of the plurality of rows, the plurality of columns, or both.

7. The method according to claim 1, wherein the specified setpoint temperature of the temperature master controller is variable, and wherein a setpoint rate of change is limited.

8. A burner controller for controlling a fuel supply to a plurality of burners of a burner group, the burner controller comprising at least one port for a temperature sensor, at least one port for a flow sensor and a calculating unit in which the method for controlling the fuel supply according to claim 1 is implemented.

9. A pelletizing plant comprising a traveling grate firing machine with a plurality of burners of a burner group and the burner controller for controlling the fuel supply to the plurality of burners of the burner group according to claim 8.

10. A method for controlling a fuel supply to a plurality of burners of a burner group, the method comprising:

determining a temperature in the burner group as a control variable;

specifying, as a correcting variable, the fuel supply to the burners of the burner group in dependence on a control deviation of the temperature determined in the burner group to a specified setpoint temperature, the fuel supply being a common mean fuel supply that is specified for all of the burners of the burner group by a temperature master controller of a controller that is formed as a temperature-to-flow cascade controller; and correcting the fuel supply for each of the burners or burner subgroups of the burner group, each of the burners or the burner subgroups having a fuel supply slave controller, the fuel supply slave controllers using at least one disturbance variable associated to the respective burner or the respective burner subgroup so as to perform the correcting of the fuel supply for each of the burners or the burner subgroups of the burner group, wherein at least one of the temperature determined in the burner group and the at least one disturbance variable is determined from temperature measurements in the burner group.

11. A method for controlling a fuel supply to a plurality of burners of a burner group, the method comprising:

determining a temperature in the burner group as a control variable;

specifying, as a correcting variable, the fuel supply to the burners of the burner group in dependence on a control deviation of the temperature determined in the burner group to a specified setpoint temperature, the fuel supply being a common mean fuel supply that is specified for all of the burners of the burner group by a temperature master controller of a controller that is formed as a temperature-to-flow cascade controller; and correcting the fuel supply for each of the burners or burner subgroups of the burner group, each of the burners or the burner subgroups having a fuel supply slave controller, the fuel supply slave controllers using at least one disturbance variable associated to the respective burner or the respective burner subgroup so as to perform the correcting of the fuel supply for each of the burners or the burner subgroups of the burner group, wherein the corrected fuel supply for each of the burners or the burner subgroups is limited to a maximum fuel supply.

* * * * *